United States Patent [19]

Williams et al.

[11] Patent Number: 4,634,921

[45] Date of Patent: Jan. 6, 1987

[54] THERMIONIC CATHODE HEATER

[75] Inventors: Kenneth E. Williams, Andover; William A. Frutiger, Beverly; Kenneth E. Hall, Lynnfield, all of Mass.

[73] Assignee: Sony Corporation, Tokyo, Japan

[21] Appl. No.: 627,649

[22] Filed: Jul. 3, 1984

[51] Int. Cl.[4] ..... H01J 1/15

[52] U.S. Cl. ..... 313/342; 250/492.2

[58] Field of Search ..... 250/492.2; 313/342

[56] References Cited

U.S. PATENT DOCUMENTS

| | | | |
|---|---|---|---|
| 1,682,642 | 8/1928 | Van Der Pool | 313/342 |
| 1,701,356 | 2/1929 | Bruckel et al. | 313/342 |
| 1,814,681 | 7/1931 | Franklin | 313/342 |
| 1,878,089 | 9/1932 | Albershein | 313/342 |
| 1,881,644 | 10/1932 | Jones | 313/342 |
| 2,057,931 | 10/1936 | Stupakoff | 313/342 |
| 2,089,817 | 8/1937 | Stutsman | 313/342 |
| 4,382,186 | 5/1983 | Denholm et al. | 250/492.2 |
| 4,473,777 | 9/1984 | Steinberg | 313/342 |

*Primary Examiner*—Harold Dixon

*Attorney, Agent, or Firm*—Lewis H. Eslinger; Alvin Sinderbrand

[57] ABSTRACT

A heater for a thermionic cathode for producing an electron beam includes a central wide and a hollow cylindrical conductor with the wire disposed coaxially thereof. The wire and the cylindrical conductor are electrically connected at one end of the heater and at the other end include means for connecting to a power source. Equal electrical currents thus flow in opposite directions in the wire and the cylindrical conductor so that the magnetic fields produced thereby tending to deflect the electron beam cancel each other.

17 Claims, 5 Drawing Figures

FIG. 2
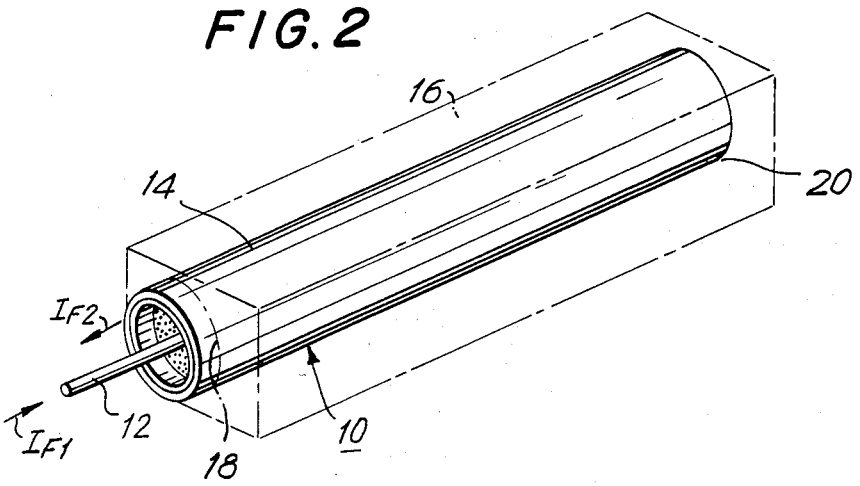
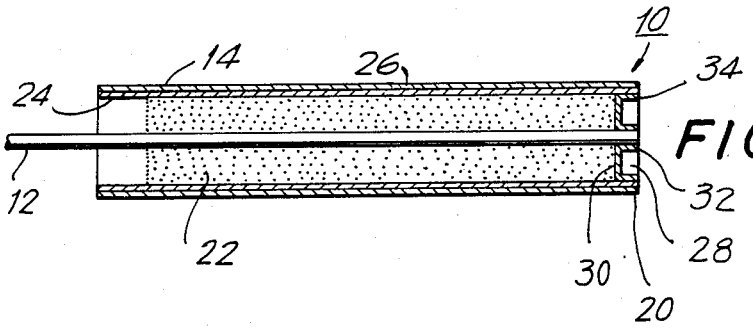
FIG. 3
FIG. 5
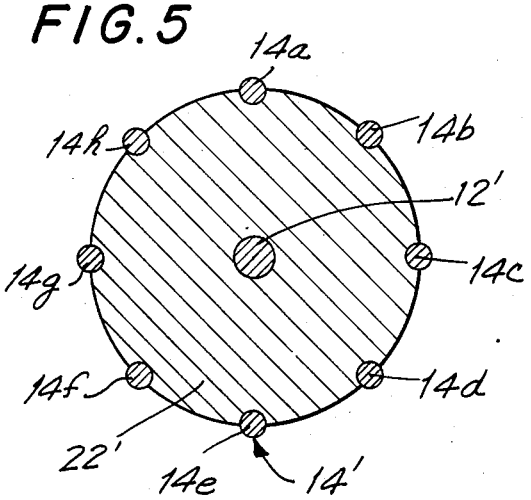
FIG. 4
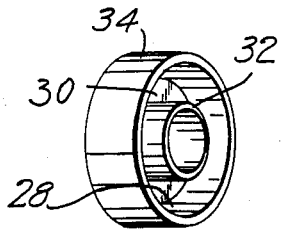

THERMIONIC CATHODE HEATER

BACKGROUND OF THE INVENTION

1. Field of the Invention

The present invention relates to a heater and, more particularly, to a heater for a thermionic cathode.

2. Description of the Prior Art

Thermionic emission of electrons is a well-known phenomenon utilized to generate an electron beam. The emitted electrons can be shaped by known techniques into beams of various shapes for performing many useful functions. For example, U.S. Pat. Nos. 3,702,412; 3,745,396; 3,769,600 and 3,780,334 disclose apparatus in which elongated cathodes are heated by electric resistance.

U.S. Pat. No. 4,382,186 (which has been disclaimed in favor of U.S. Pat. No. 4,446,373 assigned to the assignee of the present invention) discloses an intense, fine-line, strip electron beam that can be used in many applications. It is particularly important in such applications to provide the electron beam at a predetermined location with predetermined dimensions. However, the magnetic fields associated with the generation and focussing of the electron beam, particularly the field set up by the electrical cathode heater, prevent accurate focussing and placement of the beam under many operating conditions.

SUMMARY OF THE INVENTION

It is an object of the present invention to overcome the aforementioned disadvantages of prior art thermionic cathode heaters.

It is another object of the present invention to provide a thermionic cathode heater that creates substantially no magnetic field that will cause deflection of the electrons extracted from the cathode.

In accordance with an aspect of the present invention, a heater for a thermionic cathode capable of providing a strip electron beam comprises a first current carrying means extending in a predetermined direction and a second current carrying means disposed relative to said first current carrying means along said predetermined direction for substantially preventing the creation of a magnetic field causing deflection of the electron beam by said heater when electric current flows in opposite directions along said first and second current carrying means.

Those and other features, objects and advantages of the present invention will be apparent from the following detailed description of preferred embodiments of the invention when considered with the drawings.

BRIEF DESCRIPTION OF THE DRAWINGS

FIG. 2 is an isometric view of a cathode heater in accordance with an embodiment of the present invention.

FIG. 3 is a longitudinal cross-section of the heater shown in FIG. 2.

FIG. 4 is an isometric view of the end connector of the cathode heater shown in FIG. 2.

FIG. 5 is a cross-sectional view of an alternate embodiment of a cathode heater in accordance with the present invention.

DETAILED DESCRIPTION OF PREFERRED EMBODIMENTS

Figure 1:
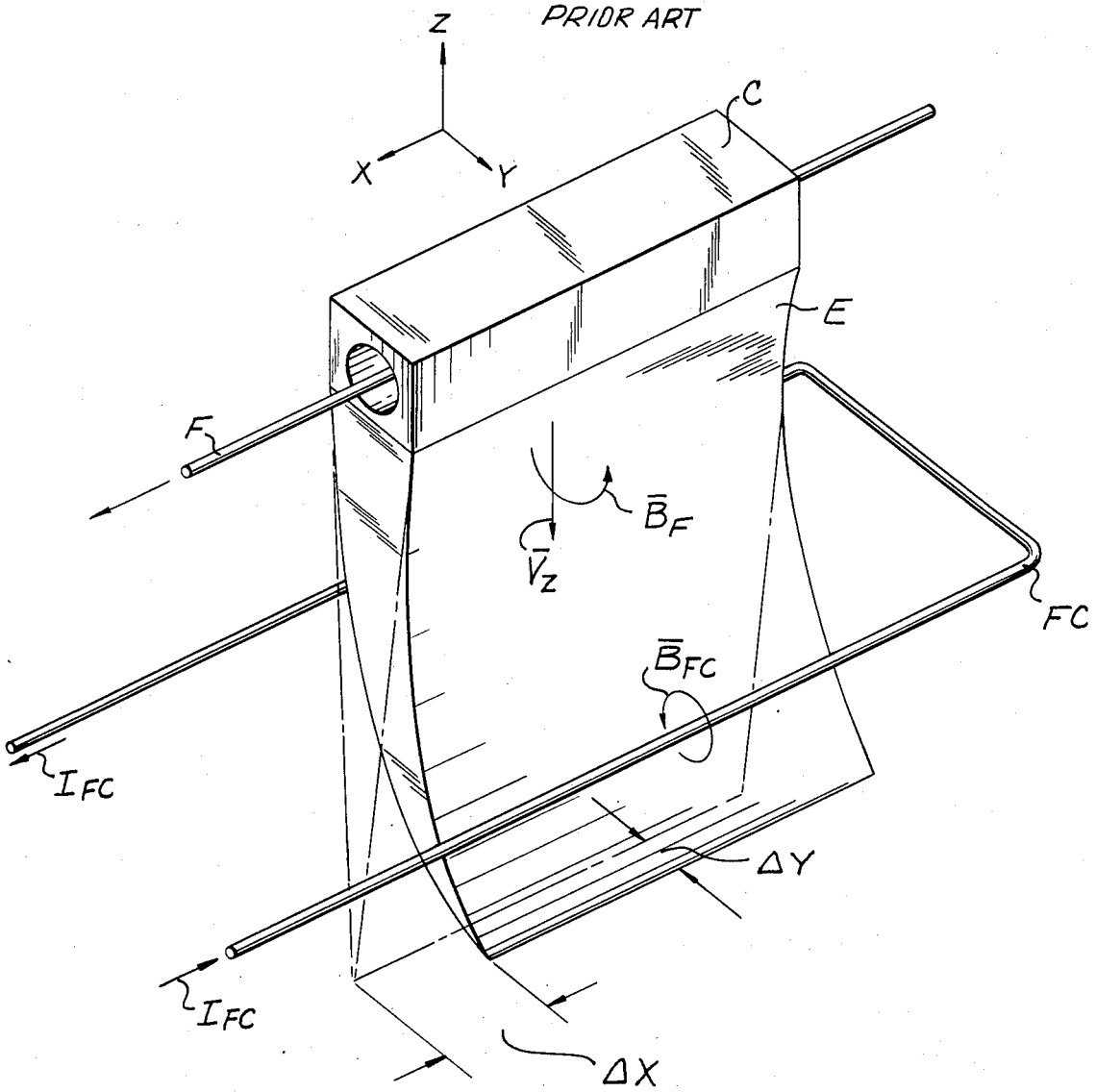
FIG. 1 PRIOR ART
FIG. 1 is isometric view of a prior art thermionic cathode-heater assembly.

The present invention can be best understood by considering a fine-line, strip electron beam generated by a thermionic cathode heated by a prior art electrical resistance heater.

As shown in FIG. 1, a schematically represented apparatus includes a thermionic cathode C made of a material that emits electrons from its surface when heated. Such materials are well known in the art and include sintered tungsten, often impregnated by other electron-emitting materials. A cathode heater filament F extends along the length of the cathode C within a longitudinal bore provided through the cathode C. Insulation such as powdered alumina ($Al_2O_3$) is generally placed within the bore to locate and insulate the filament F. The insulation is omitted from FIG. 1 for clarity.

When a current $I_F$, which is conventionally an alternating current, passes through the filament F, the filament F acts as a resistance heater to raise the temperature of the cathode C to cause the emission of electrons therefrom. An extraction grid (not shown) and focussing coils FC accelerate and focus the electrons into a fine-line electron beam E. The electron beam E can be used as described in the aforementioned U.S. Pat. No. 4,382,186.

The electron beam E ideally assumes the configuration shown in phantom lines in FIG. 1. Using an orthogonal x,y,z coordinate system as shown in FIG. 1, with the cathode C and the filament F extending along the x-axis, the electron beam E is intended to be focussed as shown in FIG. 1 at a line parallel to the x-axis at a distance from the cathode in the -z direction.

However, the filament current $I_F$ in the x-direction creates a magnetic filed in the y-z plane having lines of induction $\overline{B}_F$ as shown in FIG. 1. The electrons in the beam E, moving with the velocity $-v_z$, are subjected to a force in the $-$x-direction in accordance with the relationship $\overline{F}=e\overline{V}\times\overline{B}_F$, where e is the charge on an electron, $\overline{V}$ is the velocity vector of the electron, $\overline{B}_F$ is the magnetic induction vector representing the magnetic field set up by the filament current $I_F$, and "X" is the vector- or cross-product of the velocity and magnetic induction vectors. The resulting force $\overline{F}$ deflects the electron beam E a distance $\Delta x$, as shown in FIG. 1.

This deflection in the x-direction of the electron beam E (shown in FIG. 1 only for one direction of the alternating current $I_F$) would not have a significant effect on the usefulness of the electron beam E for the purposes set forth in the above-identified patent, although it is possible that for some applications this deflection would be undesirable.

However, the current $I_{FC}$ in the focussing coils FC also creates a magnetic field in the y-z plane having lines of induction $\overline{B}_{FC}$ as shown in FIG. 1. The velocity of the electrons in the $-$x-direction, as a result of the magnetic induction $\overline{B}_F$, creates a force on the electrons in the $+$y-direction. That is, a force tending to deflect the electrons in the beam E in the y-direction is created as shown by application of the equation $\overline{F}=e\overline{V}\times\overline{B}_{FC}$.

That deflection, shown as $\Delta y$ in FIG. 1, cannot be tolerated. It prevents sufficiently accurate focussing of the electrons beam E to form a fine-line of electrons of intense charge at the material being treated.

It would be possible to elminate the $\Delta y$ deflection by eliminating the filament current $I_F$ when the focussingcoil current $I_{FC}$ is flowing. That could be accomplished when using an AC filament current by pulsing the focussing current $I_{FC}$ only when the filament current crosses the zero-current level. Another possible approach is on-off modulation of the filament current and focussing current so that they are not on at the same time. For this approach, the cathode is heated and then the filament current $I_F$ is turned off. For many applications, the cathode will stay hot long enough to emit electrons for a sufficient time to permit them to be focussed into the electron beam B. But the first of those approaches requires additional controls and the second is unsuitable for long or continuous operation of the cathode.

Another potential solution would involve using a DC filament current. This would theoretically, at least, enable the $\Delta y$ deflection shown in FIG. 1 to be eliminated by proper design of the focussing coils FC. In practice, however, minor variations in the filament current level would necessitate a complicated control system to enable the focussing coils to shape the electrons into the fine-line beam required for applications such as are described in U.S. Pat. No. 4,382,186.

FIG. 2 illustrates a thermionic cathode incorporating a cathode heater in accordance with the present invention. The cathode heater 10 includes a straight wire 12 and a conducting circular cylinder 14 having the wire 12 disposed at the axis thereof. The conductor 14 in the present embodiment is circular, but other cross-sectional configurations are possible, as will be understood as the present description proceeds.

A cathode member 16 (shown in phantom lines in FIG. 2) has a central bore 18 therethrough. The central bore 18 has a cross-section which matches the cross-section of the conductor 14 of the heater 10. As shown in FIG. 2, the heater 10 fits within the bore 18. An end connector (not shown in FIG. 2) electrically connects the ends of the wire 12 and the cylinder 14 in series at their ends 20.

In operation, the cathode member 16 is heated when current $I_{F1}$ flows along the wire 12 in one direction, through the end connector and back along the cylinder 14 in the other direction, as indicated at $I_{F2}$. Since the magnitude of the current flowing in the wire and the cylinder are the same, the magnetic field at points external to the cathode, tending to deflect the electron beam, is zero. Thus, the heater 10 of the present invention substantially prevents (by creating mutually cancelled magnetic fields externally of the cylinder 14) the creation of a magnetic field causing deflection of the electron beam when electric current flows in opposite directions through the wire 12 and the cylinder 14. As a result, there will be no deflection of the electron beam in the x-direction and thus none in the y-direction caused by the x-component of the velocity of the electrons in the deflected electron beam passing through the focussing magnetic field.

FIGS. 3 and 4 show the heater 10 according to this embodiment of the present invention in more detail. FIG. 3 is a cross-sectional view taken along the axis of the wire 12 and shows the powdered insulation 22 that insulates the wire 12 from the cylinder 14 and also acts to support and position the wire 12 accurately relative to the cylinder 14. The wire 12 must be coaxial with the cylinder 14 to prevent the creation of a magnetic field, and the insulation 22 performs this positioning function and makes the heater a self-contained unit; that is, it is structurally independent of the cathode member. The insulation 22 will commonly be powdered alumina or silicon oxide (SiO).

FIG. 3 shows more clearly that the cylinder 14 includes a conductor 24 that is formed of a suitable refractory material such as tungsten, molybdenum or tantalum. Of course, the material forming the cylindrical conductor 24 must be non-ferromagnetic at the operating temperatures of the heater (as high as 1000° C. or more) or the magnetic fields produced by the wire 12 and the conductor 24 will not cancel each other. The cathode 16 is commonly made from an electrically conducting material, sintered tungsten being a commonly used material for thermionic cathodes as pointed out above. Thus, the cylinder 14 also includes an insulating layer 26 over the conductor 24. The insulating layer 26 will typically be alumina or other insulation that can withstand elevated temperatures, such as aluminum nitride.

The wall of the conductor 24 is made as thin as possible to increase its resistance to current and thus increase the heat it generates for a given amount of current. Since the heat generated by any resistance is proportional to $I^2R$ (where I = current and R = resistance), and R increases with decreasing cross-sectional area of the conductor, decreasing the wall thickness of the conductor 24 provides a more efficient heater. That is, the wire 12 will generally have a lower resistance than the cylindrical conductor 24 since the space between the wire 12 and the cathode 10 prevents efficent use of the wire for heating. If the wire 12 presents relatively little resistance to current flow, and the conductor 24 presents higher resistance, the heat transferred to the cathode member 16 can be optimized without unduly increasing the power required by the heater.

It will also be appreciated that the use of the cylindrical conductor 24 enables the heat generated by the conductor to be efficiently transferred to the cathode 16. The outside of the cylinder 14 and the inside of the bore 18 are in intimate contact over a large surface area, which increases the heat transferred between the cylinder 14 and the cathode member 16.

The heater 10 also includes an end connector 28, which is shown in more detail in FIG. 4. It will be appreciated that the electrical connection between the wire 12 and the cylindrical conductor 24 should be made in a manner that minimizes any magnetic field that would deflect the electrons issuing from the cathode member 16.

To that end the end connector 28 provides a radially symmetrical current path between the wire 12 and the conductor 24. That is, current in the end connector 28 in the radial direction will be substantially the same at all circumferential locations at a particular radius. The end connector 28 comprises a disc portion 30 having an internal flange 32 and an external flange 34. The internal flange 32 fits over the end of the wire 12, to which it is fixed by a suitable method such as welding. The external flange 34 fits inside the end of the conductor 24 and is fixed thereto, for example, by welding.

The other end 36 of the heater provides means for connection of the wire 12 and the conductor 24 to a power source to cause a current to flow through the heater 10. A feature of the present invention is the ease with which the heater 10 in a cathode can be replaced, in part because electrical connections to the heater are made at one end of the heater.

In the embodiment shown in FIGS. 2–4, the insulation 22 terminates inside the heater 10. The end 36 thus includes an exposed portion of the inner surface of the conductor 24. A mating plug-in connector for establishing electrical contact with that portion of the conductor 24 and with the wire 12 can be provided on the power source for the heater.

The use of a plug-in connection further eases the replacement of the heater. Moreover, because the cylinder 14 mates closely with the bore 18 in the cathode, the heater 10 is self-centering within the cathode member 16. In prior art heaters, the heating filament must be carefully centered within the bore of the cathode member to prevent uneven heating of the cathode.

FIG. 5 shows an alternate embodiment of the heater 10 shown in FIGS. 2–4. The heater 10' in FIG. 5 is shown in cross-section taken in a plane normal to the axis of the central wire 12'. The outer conductor 14' comprises a plurality of elongated conducting elements **14*a*–14*h* spaced circumferentially at equal intervals about the wire 12' and at the same radial distance from the wire 12'. Each conducting element 14*a*–14*h* comprises a central conductor having an insulating layer thereon. The wire 12' and outer conductor 14' are located relative to each other by a body of insulating material 22'. It will be appreciated that currents flowing in opposite directions in each of the central wire 12' and the outer conductor 14'** will prevent the creation of a magnetic field causing deflection of the electron beam in the heater of this embodiment of the invention.

In general, then, the wire 12 or 12' is a first current carrying means that extends in a predetermined direction and the conductor 14 or 14' is a second current carrying means disposed relative to the first current carrying means for substantially preventing the creation of a magnetic field causing deflection of the electron beam by the heater when electric current flows in opposite directions along the first and second current carrying means.

Although specific embodiments of the invention have been described in detail herein with reference to the accompanying drawings, it is to be understood that the invention is not limited to those embodiments, and that various changes and modifications can be affected therein by one skilled in the art without departing from the scope or spirit of the invention as defined in the appended claims.

What is claimed is:

1. A heater for insertion into a thermionic cathode capable of providing a strip electron beam, the heater comprising:

a first current carrying means extending in a predetermined direction; and a second current carrying means disposed in series with and substantially surrounding said first current carrying means along said predetermined direction for substantially preventing the creation of a magnetic field causing deflection of the electron beam by said heater when electric current flows in opposite directions along said first and second carrying means;

said second current carrying means having a higher resistance to electrical current and generating greater $I^2R$ heating than said first current carrying means.

2. A heater as in claim 1; wherein:

said first current carrying means includes a substantially straight wire; and said second current carrying means includes a hollow cylindrical conductor having said straight wire disposed coaxially therewith.

3. A heater as in claim 2; wherein said cylindrical conductor is circular in cross-section and the heater further comprises an end connector for electrically connecting said straight wire to said cylindrical conductor at the same ends thereof to connect said straight wire and said cylindrical conductor in series.

4. A heater as in claim 3; wherein said end connector provides a radially symmetrical current path between said wire and said cylindrical conductor.

5. A heater as in claim 3; further comprising insulating material disposed inside said cylindrical conductor, said insulating material supporting said wire.

6. A heater as in claim 5; wherein said insulating material is selected from the group consisting essentially of powdered alumina and silicon oxide.

7. A heater as in claim 3; wherein said cylindrical conductor is substantially nonferromagnetic at the operating temperatures of the heater.

8. A heater as in claim 3; wherein said cylindrical conductor has an insulating layer on the exterior thereof.

9. A heater as in claim 8; wherein said insulating layer is alumina.

10. A heater as in claim 3; wherein the end of the heater opposite said end connector includes connector means for providing a readily disconnectible connection of said wire and said cylindrical conductor to a power source for the heater.

11. A thermionic cathode for providing a strip electron beam extending in a predetermined direction, the cathode comprising:

a cathode member extending in the predetermined direction for emitting electrons when heated and having a central bore therethrough in the predetermined direction; and a cathode heater disposed in said bore and including a first current carrying means extending along said bore and a second current carrying means disposed in series with and substantially surrounding said first current carrying means and proximate to the walls of said bore and substantially preventing the creation of a magnetic field causing deflection of the electron beam by said heater when electric current flows in opposite directions along said first and second current carrying means;

said second current carrying means having a higher resistance to electrical current and generating greater $I^2R$ heating than said first current carrying means.

12. A thermionic cathode as in claim 11; wherein:

said bore has a substantially circular cross-section;

said first current carrying means includes a substantially straight wire disposed substantially at the axis of said bore; and said second current carrying means includes a hollow, circularly cylindrical conductor.

13. A thermionic cathode as in claim 12; wherein said cathode member is a conducting material; and said cylindrical conductor has insulation on the outside thereof.

14. A thermionic cathode as in claim 13; wherein said heater further includes:

an end connector for electrically connecting said straight wire to said cylindrical conductor at the same ends thereof to connect said straight wire and said cylindrical conductor in series; and insulating material disposed inside said cylindrical conductor supporting said wire to provide said heater as a self-contained unit.

15. A thermionic cathode as in claim 14; wherein said end connector provides a radially symmetrical current path between said wire and said cylindrical conductor for substantially preventing the creation of a magnetic field causing deflection of the electron beam by said end connector when current flows therethrough.

16. A thermionic cathode as in claim 15; wherein said cathode heater is removable from said bore.

17. A thermionic cathode as in claim 16; wherein said cathode heater includes connector means at the end thereof opposite said end connector for providing a readily disconnectible connection of said wire and said cylindrical conductor and a power source for the heater.

* * * * *